US009827808B1

(12) United States Patent
Yip

(10) Patent No.: US 9,827,808 B1
(45) Date of Patent: Nov. 28, 2017

(54) CONTROL COMPONENT FOR A SINGLE DETENT BINDER

(71) Applicant: Sau Fung Yip, Kowloon (HK)

(72) Inventor: Sau Fung Yip, Kowloon (HK)

( * ) Notice: Subject to any disclaimer, the term of this patent is extended or adjusted under 35 U.S.C. 154(b) by 0 days.

(21) Appl. No.: 15/448,714

(22) Filed: Mar. 3, 2017

(51) Int. Cl.

| | |
|---|---|
| ***B42F 13/16*** | (2006.01) |
| ***B42F 13/20*** | (2006.01) |
| ***B42F 13/22*** | (2006.01) |
| ***B42F 13/26*** | (2006.01) |
| ***B42F 13/40*** | (2006.01) |

(52) U.S. Cl.
CPC ..... *B42F 13/26* (2013.01); *B42F 13/20* (2013.01); *B42F 13/22* (2013.01); *B42F 13/40* (2013.01); *B42P 2241/16* (2013.01)

(58) Field of Classification Search
CPC ..... B42F 13/16; B42F 13/20; B42F 13/22; B42F 13/26
USPC ..... 402/29–31, 36–39
See application file for complete search history.

(56) References Cited

U.S. PATENT DOCUMENTS 7,819,602 B2 10/2010 To
8,480,327 B2 * 7/2013 Horn ..... B42F 13/26 402/34
9,409,436 B2 * 8/2016 Warmus ..... B42F 13/26
2002/0122687 A1 * 9/2002 Horn ..... B42F 13/26 402/16
2006/0056906 A1 * 3/2006 Horn ..... B42F 13/26 402/31
2006/0088364 A1 * 4/2006 Whaley ..... B42F 13/26 402/38
2006/0228164 A1 * 10/2006 Horn ..... B42F 13/26 402/31
2015/0063896 A1 * 3/2015 To ..... B42F 13/26 402/40
2017/0144471 A1 * 5/2017 Yip ..... B42F 13/26

FOREIGN PATENT DOCUMENTS

WO WO 2010081794 A2 * 7/2010 ..... B42F 13/26

* cited by examiner

*Primary Examiner* — Kyle Grabowski
(74) *Attorney, Agent, or Firm* — Brett A. Schenck

(57) ABSTRACT

A single-detent binder for holding loose-leaf paper sheets is provided. The binder mainly includes a housing, one pair of symmetrically elongated baseplates, ring shaped components, a control component, a press cap, an intermediate junction component, a pull rod and rotary locking pieces. The control component is operable to move the rings for performing the locking and unlocking function. As the handle forms an essential and irreplaceable part of the whole mechanism, disclosed are embodiments of a single-detent binder with the control component constructed in away to improve the durability of the internal components.

21 Claims, 10 Drawing Sheets

CONTROL COMPONENT FOR A SINGLE DETENT BINDER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention generally relates to a single detent binder for holding loose-leaf paper sheets or the like, and in particularly, a single-detent binder that is provided with an improved design of the control component so as to enhance the endurance and durability of the internal components.

2. Description of Related Art Including Information Disclosed Under 37 CFR 1.97 and 37 CFR 1.98

In order to insert or take out loose-leaf paper sheets conveniently, a single-detent binder (also known as a loose-leaf ring binder) is widely used for a file folder or note book. As known in the prior art, a typical single-detent binder mainly comprises an elongate curved housing, a pair of elongate baseplates, a plurality of ring shaped components and one or more control handles. The two longitudinal sides of the housing are bent inwards to form two inner sides. The pair of baseplates is located inside the cavity formed by the curved housing, so that one of the two longitudinal sides of each baseplate abuts upon the inner side of the housing while the longitudinal sides on the other side of the baseplates are interconnected in parallel, thus forming a central hinge possessing a pivot axis. Each baseplate is fixedly connected to a plurality of half ring-shaped elements. At least one end of the loose-leaf binder is usually connected to a control handle, and the control handle is able to operate one pair of baseplates to move the central hinge upwards or downwards, so that the half ring shaped elements connected to the baseplates reciprocate between the open and closed positions.

In said single-detent binder mechanism, a user operates the handle on the control component to occlude and disjoin the rings. The handle procures the opening or closing by moving a pull rod (also known as a travel bar in some prior art) connected to it which eventually procures the opening or closing of the rings, which move the central hinge upwards or downwards through its extension arms. In general, such handle is made of plastic and pivoted on a pivot pin for rotation. When the binder is operated repeatedly, the plastic handle is under constant and repeated exertion of force by the user which can cause material weakening, fatigue and deformation. In some cases, the extension arms on such handle can even be bended and cracked when excessive force is applied to the handle by the user. As the handle forms an essential and irreplaceable part of the whole mechanism, without the handle, the whole single-detent binder will be useless. Thus, durability of the handle and other internal components upon repeated operation of opening and closing of the ring is a vital feature of the control component for prolonging the life of the single-detent binder.

United States Pub. App. No. 20150063896 discloses a ring binder mechanism in which the control handle (referred to as actuator in the application) causes the pivoting motion of the hinge plates through its closing arm against the spring force from the housing to open and close the rings. However, in such mechanism, the spring force from the housing will inevitably be exerted on the closing arms and causes wear and tear and eventually breaks the closing arm, rendering the control handle useless.

U.S. Pat. No. 7,819,602 discloses a ring binder mechanism similar to the above. The control handle touches the base plate at a single pivot point. The pivot point of the handle is not directly below the lever arm on which users exert force, so that there is no support below the lever arm. Thus, excessive force exerted on the lever arm by users may thus break the lever arm over prolonged use of the control handle.

As a result, an improved design of a single-detent binder, preferably constructed with a control component that can resist excessive force on the control handle, is needed for the production of a more reliable and durable single-detent binder.

BRIEF SUMMARY OF THE INVENTION

To overcome the defects of the prior art above, a single-detent binder for holding loose-leaf paper sheets with improved durability of the internal components is provided.

In accordance with the present invention, the single-detent binder includes a housing, a pair of symmetrically elongated baseplates, one or more ring shaped components for holding loose-leaf paper, a control component, an intermediate junction component, a pull rod and a plurality of rotary locking nails, wherein the control component is configured and characterized with at least one bridge or other connectors connecting and bridging the head of the upper extension arm and the head of the lower extension arm to form a closed loop with a cavity in the middle for improving the durability of the upper extension arm and the lower extension arm when opening and closing the single-detent binder.

In accordance with a more detailed aspect of the present device, the handle can be rotated by the user relative to the housing for opening and closing of the single-detent binder. The upper extension arm possesses a through hole for connecting the control component to one end of said intermediate junction component, and the lower extension arm applies force on the pair of baseplates and limits the rotation of the control component to be within a pre-determined degree.

The inner longitudinal edges of the pair of baseplates are interconnected in parallel and are pivoted around each other to form a central hinge for opening or closing of the ring-shaped components. The intermediate junction component has one end connected to the upper extension arm, and the other end connected to a pull rod. The pull rod is provided with an elongate main rod and a connection end for connecting to the intermediate junction component. The rotary locking nail rotativity connects one end of the rotary locking piece to the round hole on the pull rod, and the other end of the rotary locking piece is clamped to the baseplate.

In accordance with another more detailed aspect of the present device, the control component possesses a bridge connecting the upper extension arm and lower extension arm to form a close loop with a cavity in the middle for preventing the lower extension arm from bend or crack after prolonged use of the binder. Two finger-like parts at the open longitudinal end of said pair of baseplates are arranged laterally, separated by a notch of a width more than the width of the bridge and are connected to the cavity in the control component.

In accordance with an alternative of the present device, the single-detent binder includes a housing, a pair of symmetrically elongated baseplates, one or more ring shaped components for holding loose-leaf paper, a control component, a press cap with two downward extension parts, an intermediate junction component, a pull rod and a plurality of rotary locking nails, wherein the lower extension arm is configured and characterized with a guide pin and a curved surface for improving the durability of the upper extension arm and the lower extension arm by providing a pivot for the control component and limiting the rotation of the control component to be within a pre-determined degree when opening and closing the single-detent binder.

In accordance with another more detailed aspect of the present device, the press cap connects and fixes the control component to the housing via one or more rivets. The downward extension part of the press cap is characterized with a curved inner edge as a guide path for the guide pin to move along so as to limit the rotation of said control component to be within a pre-determined degree, wherein the curved inner edge of the downward extension part obstructs the movement of the guide pin on the lower extension arm which in turn prevents the control component from rotating exceeding a pre-determined angle of turning when opening and closing the single-detent binder.

In accordance with another more detailed aspect of the present device, the handle of the control component is extended downward and connected to the lower extension arm with a curved surface. At open position of the single-detent binder, such curved surface, connecting between said handle and said lower extension arm, firmly abuts against the file folder or note book and serves as a pivot for the control component.

Additional features and advantages of the invention will be apparent from the detailed description which follows, taken in conjunction with the accompanying drawings, which together illustrate, by way of example, features of the invention.

BRIEF DESCRIPTION OF THE SEVERAL VIEWS OF THE DRAWINGS

Embodiments of the invention are described and can be better understood with reference to the accompanying drawings. The components in the drawings may not be drawn to scale. In the drawings, like reference numbers may indicate identical or functionally similar elements.

DETAILED DESCRIPTION OF THE INVENTION

Figure 1:
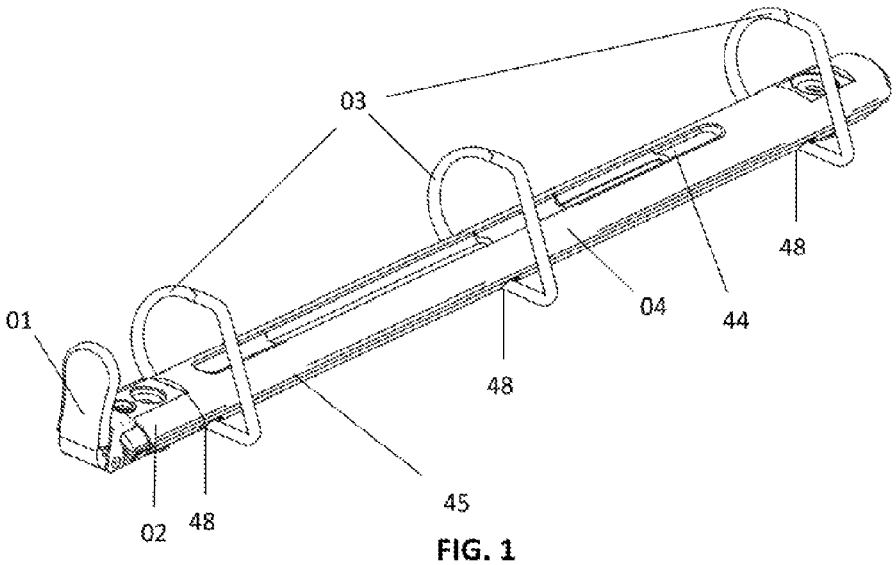
FIG. 1 is a perspective view of one embodiment of a single-detent binder of the present invention.

The present invention relates to a single-detent binder. In the detailed description of the invention herein, references to "one embodiment", "an embodiment", etc., indicate that the embodiment described may include a particular feature, structure or characteristic, however every embodiment may not necessarily include such particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

The articles "a", "an", "the" and "said" are intended to mean that there are one or more of the elements. The terms "comprising", "including" and "having" and variations thereof are intended to be inclusive and mean that there may be additional elements other than the listed elements. As various changes could be made in the above without departing from the scope of the invention, it is intended that all matter contained herein the description and any accompanying figures shall be interpreted as illustrative and not in a limiting sense.

Referring now to the drawings, FIG. 1-19 shows one embodiment of a single-detent binder in the present invention. This embodiment mainly comprises a housing 04, a pair of baseplates 05, one or more ring shaped component 03 for holding loose-leaf paper, a control component 01 with vertical handle 11, an intermediate junction component 09, a pull rod 06 and a plurality of rotary locking nails 07. FIG. 20-25 shows an alternative embodiment of a single-detent binder with a horizontal control component 01*a* with horizontal handle 11*a*. It should be understood that the single-detent binder may assume a shape different from the shapes as shown in these figures or be integrated into a whole mechanism with a file folder or note book, which is within the scope of protection of the present invention.

Figure 3:
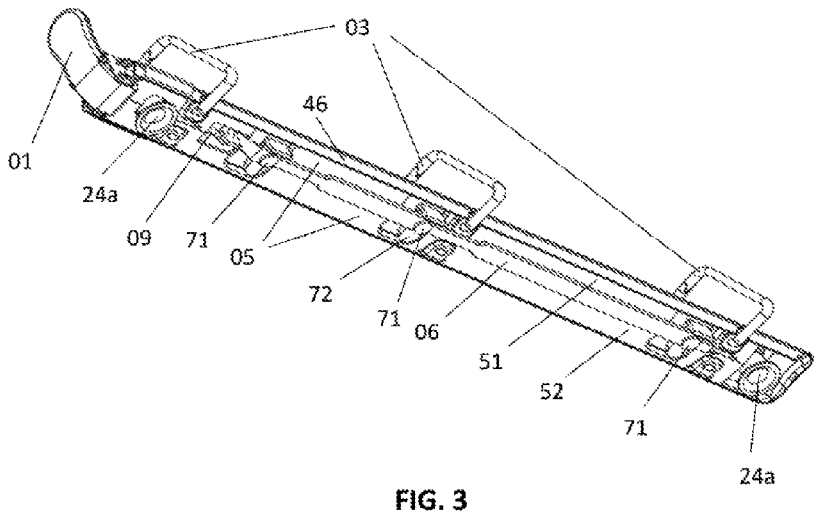
FIG. 3 is a bottom perspective view of the single-detent binder.
Figure 4:
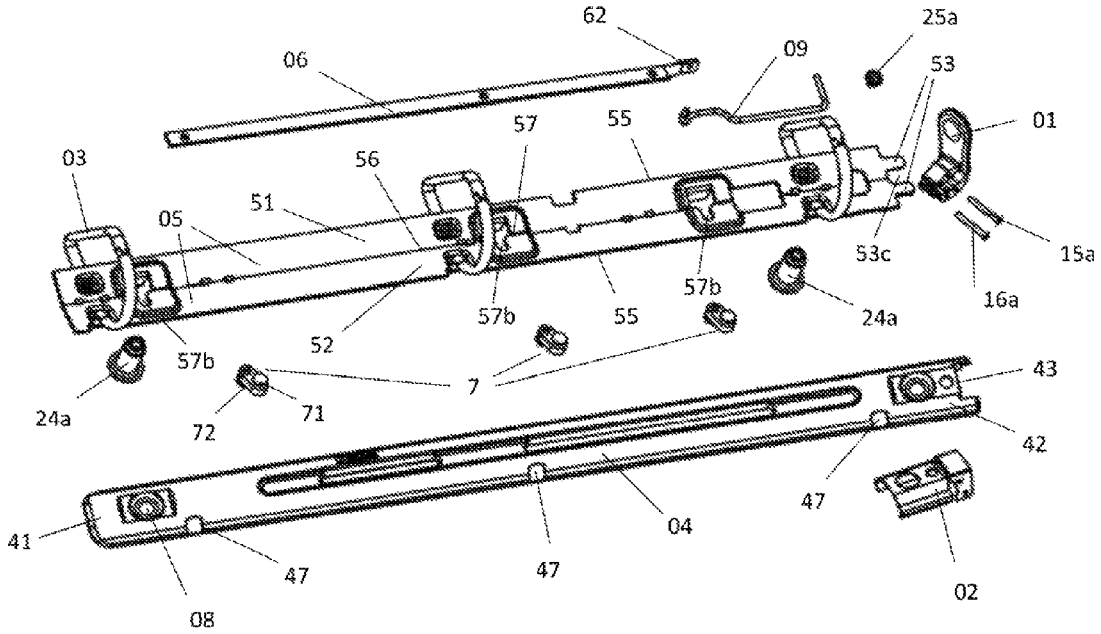
FIG. 4 is an exploded perspective view of the single-detent binder.
Figure 5:
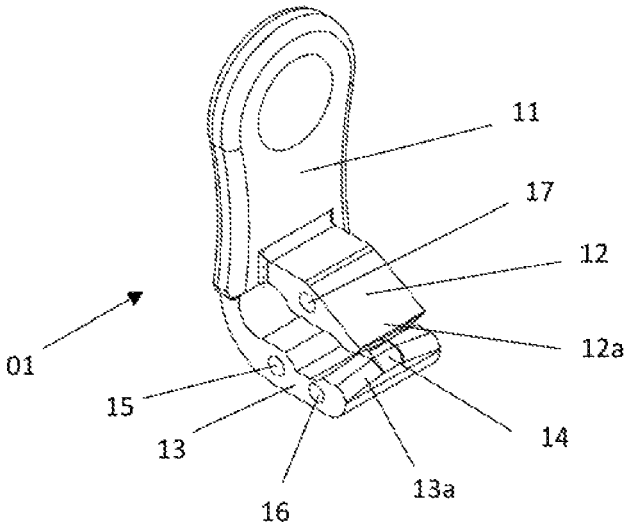
FIG. 5 is a perspective view of the control component of the single-detent binder.
Figure 6:
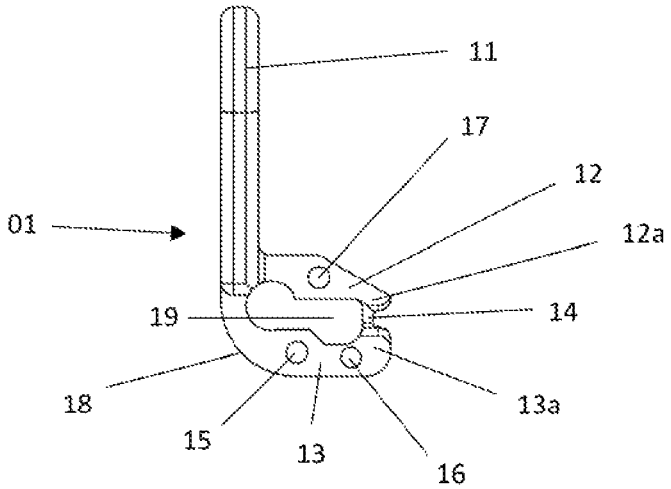
FIG. 6 is a fragmentary section of the control component of the single-detent binder.
Figure 7:
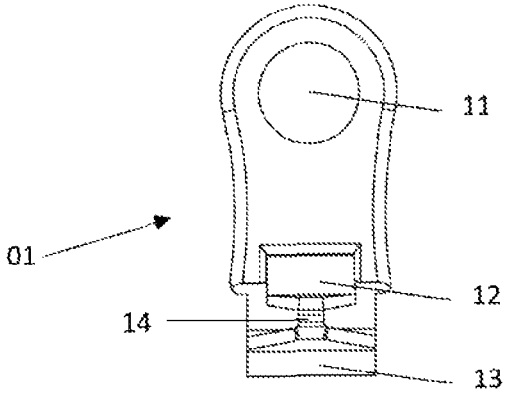
FIG. 7 is a front view of the control component of the single-detent binder.
Figure 8:
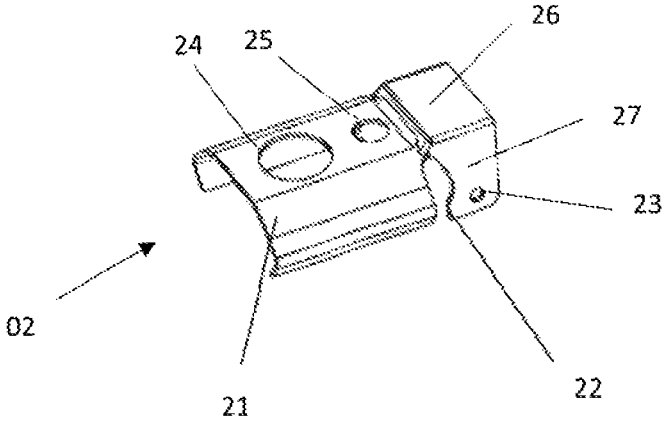
FIG. 8 is a perspective view of the press cap of the single-detent binder.

In FIGS. 1, 3 and 4, the single-detent binder is shown at the closed position. Generally, the disclosed single-detent binder holds loose-leaf paper with three ring shaped components 03, and the single-detent binder is mounted on a file folder or note book. The control component 01 is mounted on the opened end 42 of the single-detent binder for opening and closing the ring-shaped components 03. The top of the housing 04 is an elongate sunken space 44. The housing 04 is bent downward along the two longitudinal sides at its top, forming two longitudinal side faces 45. The longitudinal sides of the two longitudinal side faces 45 are extended and bent inwards to form two inner side faces 46, so that the two outer longitudinal edges 55 of one pair of baseplates 05 abut upon the two inner side faces 46, thus allowing one pair of baseplates 05 to pivot inside the housing 04. The edged and narrowed inner side faces 46 of the housing 04 generate a force source simultaneously, and restrict the pivot angle of the pair of baseplates 05 for opening and closing of the ring-shaped components 03. The two inner side faces 46 are shorter than the two longitudinal side faces 45. One longitudinal side face 45 possesses three locating holes 47, the inner side face 46 opposite to the longitudinal side face 45 possesses three incisions 48, and the half parallelogram element 31 and the half circular element 32 pass through three incisions 48 and three locating holes 47 respectively. The housing 04 possesses two longitudinal ends, wherein one end is the closed end 41 and the other end is the opened end 42 with a housing incision 43 for installation of the control component 01 and press cap 02. The longitudinal two ends of the housing 04 respectively possess two large round holes 08, which allow the installation rivets 24*a* to pass through them for riveting the housing 04, so as to support the single-detent binder provided in the present invention and fix the binder to a file folder or note book.

As shown in FIGS. 2, 3, 4, 14 and 15, one pair of baseplates 05 comprises two baseplates elongated symmetrically, including a first baseplate 51 and a second baseplate 52, and are supported by the housing 04. The pair of baseplates 05 is made of metal, alloy or other appropriate lightweight material that possesses enough rigidity and stability. The two outer longitudinal edges 55 of one pair of baseplates 05 abut upon the two inner side faces 46 of the housing 04, while the two inner longitudinal edges 56 of one pair of baseplates 05 are interconnected in parallel, thus forming a central hinge possessing a pivot axis. The pair of baseplates 05 is provided with fixing holes 54 used to fix the ring-shaped components 03, so that the first baseplate 51 is riveted to a half parallelogram element 31 and the second baseplate 52 is riveted to a half circular element 32 for supporting the ring-shaped components 03. The pair of baseplates 05 can rotate so that the two inner longitudinal edges 56 move upwards (and thus the central hinge goes toward the housing 04) or downwards (and thus the central hinge goes away from the housing 04), while the half parallelogram element 31 and the half circular element 32 riveted to the pair of baseplates 05 are triggered to reciprocate between the open position (FIG. 1) and closed position (FIG. 2), thus opening or closing the ring-shaped components 03.

When the pair of baseplates 05 are installed and interconnected, the first baseplate 51 and second baseplate 52 jointly constitute a large groove 58, a small groove 59 and three cutting shoulders 57. The large groove 58 allows the hooked end 91 of the intermediate junction component 09 to pass through it, so that the intermediate junction component 09 is exposed outside the bottom surface of the pair of baseplates 05 and is connected to the pull rod 06 positioned below the pair of baseplates 05. The small groove 59 allows the installation rivet 24*a* to pass through it, so as to mount the single-detent binder to a file folder or note book. The second baseplate 52 is provided with three troughs 57*b* for clamping the projecting cylinders 73 of the rotary locking pieces 07, so as to fix the rotary locking pieces 07 and allow the rotary locking pieces 07 to rotate inside the trough 57*b*. The first baseplate 51 is provided with three cutting shoulders bending in perpendicular to the first baseplate 51 to form three baffle plates 57*a*. When the baseplate 05 pivot upwards or downwards, the baffle plates 57*a* hinder the rotary locking pieces 07 from rotation, thus generating a clamping force. The number of baffle plates 57*a* and the number of troughs 57*b* are respectively equal to the number of rotary locking pieces 07. However, it should be understood that the number of baffle plates 57*a*, troughs 57*b* or rotary locking pieces 07 being larger or smaller than the number as shown in the figures is within the scope of protection of the present invention.

The opened end 42 of each of the pair of baseplates 05 is provided with a narrow finger-like part 53 near the two inner longitudinal edges 56. When the pair of baseplates 05 are interconnected, the first finger-like part 53*a* and second finger-like part 53*b* jointly constitute a notch 53*c* laterally between the two finger-like parts 53. The finger-like parts 53 enable the baseplates 05 to occlude with the control component 01, so that the control component 01 can apply a force to the finger-like parts 53, thus triggering the baseplates 05 to pivot. The actual connection between the baseplates 05 and the control component 01 and their operations are described in detailed below.

Figure 2:
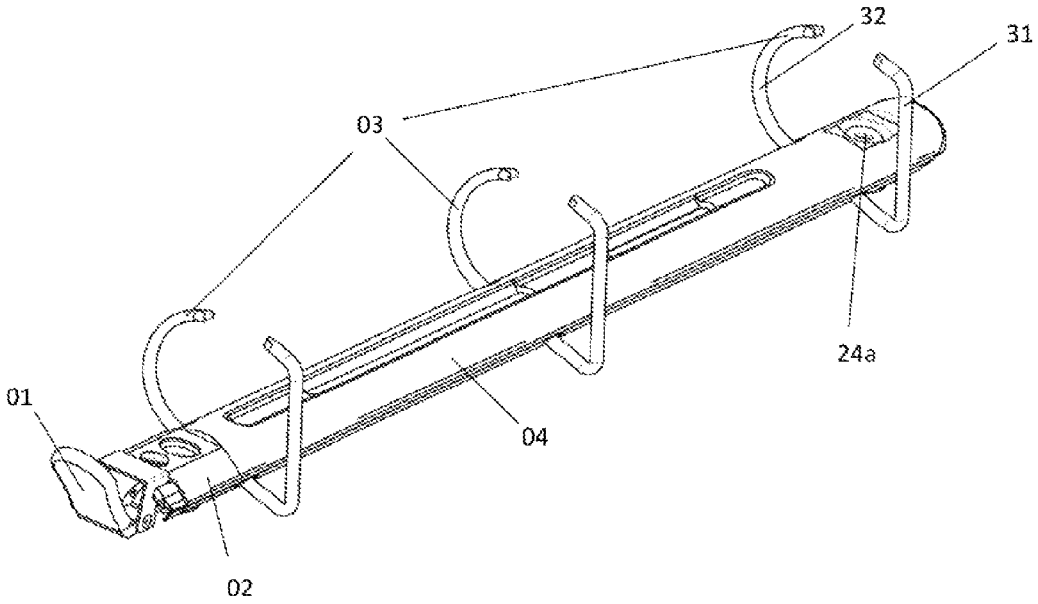
FIG. 2 is a perspective view of the single-detent binder at open position.

As shown in FIGS. 1, 2 and 4, the present invention also comprises ring-shaped components 03, made of metal, alloy or other appropriate lightweight material that possesses enough rigidity and stability. The ring-shaped components 03 are disjoined for inserting or taking out loose-leaf paper sheets, and are occluded for holding loose-leaf paper sheets in a file folder or note book. The present embodiment shows three ring-shaped components 03 and each of them comprises a half parallelogram element 31 and a half circular element 32, but it should be understood that a single-detent binder made of different material, with different number of ring shaped components 03 or assuming different shapes (for example, circular shape, oval shape or D-shape) is within the scope of protection of the present invention.

As shown in FIGS. 1, 2, 4, 8, 11 and 12, the present invention also comprises a press cap 02, which is used to connect and fix the control component 01 to the housing 04. At the top of the press cap 02 are one small hole 25 and one large hole 24. The press cap 02 is formed separately from the housing 04, locked and fastened to the housing 04 via one or more rivets 25*a* or other appropriate fasteners through the small hole 25. The large hole 24 allows the installation rivet 24*a* to pass through it, so as to mount the single-detent binder to a file folder or note book.

The press cap 02 also comprises a protruding plate 26, positioned above the housing incision 43 at the opened end 42 of the housing. The housing incision 43 and the protruding plate 26 conjointly provide sufficient space for the upper extension arm 12 of the control component 01 to turn when opening and closing the single-detent binder with less frictional force exerted by the inner surface of the protruding plate 26. The press cap 02 also comprises two downward extension parts 27 and two bended downward extension parts 21. The two downward extension parts 27 are mounted on the housing 04 alone the edge of the housing incision 43. At the bottom end of the downward extension part 27 is a small hole 23, allowing the pivot pin 15*a* to pass through it. The pivot pin 15*a* passes through the control component 01, so that the control component 01 is pivotally connected to the press cap 02. The control component 01 can pivot around a pivot axis that coincides with the pivot pin 15*a*. The two bended downward extension parts 21 is bent downward along the two longitudinal sides of the housing 04, and prevent any misalignment or loosening of the press cap 02 after the press cap 02 is installed and fastened on the housing 04.

As shown in FIGS. 1, 2, 3, 4, 5, 6, 7 and 12, the single-detent binder provided in the present invention also comprises a control component 01, which is mounted at the open end 42 of the housing 04. The control component 01 moves relative to the housing 04, so that the pair of baseplates 05 resists the elastic force of the housing 04 to occlude or disjoin the ring-shaped components 03. The control component 01 is provided with a handle 11; if a force is applied to the handle 11, the control component 01 can pivot around a pivot axis that coincides with the pivot pin 15*a*. The handle 11 assuming different shapes is within the scope of protection of the present invention. The bottom of the handle 11 is downwards and outwards extended to form an upper extension arm 12 and a lower extension arm 13. The upper extension arm 12 possesses a through hole 17, allowing the widthwise end 92 of the intermediate junction component 09 to pass through it. The lower extension arm 13 possesses first through hole 15 and second through hole 16, allowing the pivot pin 15*a* to pass through the first through hole 15 and the guide pin 16*a* to pass through the second through hole 16.

Advantageously, embodiments of the present invention have a bridge 14 or other connectors bridging and connecting the head of the upper extension arm 12*a* and the head of the lower extension arm 13*a* forming a closed loop, as illustrated in the fragmentary section (FIG. 6), with a central cavity 19 in the middle. When the single-detent binder is operated repeatedly, conventional structure of the control component 01 without a bridge would suffer material weakening, fatigue and deformation on the lower extension arm 13 as caused by constant and repeated exertion of force on the plastic handle 11 by the user. The bridge 14 in the present embodiment forms an alternative point of connection which reduce the force exerted on the lower extension arm 13 and eliminate any potential weak point on the control component 01 near the bottom end of the handle, which effectively prevent the lower extension arm 13 from bend or crack after prolonged use of the single-detent binder.

Figure 9:
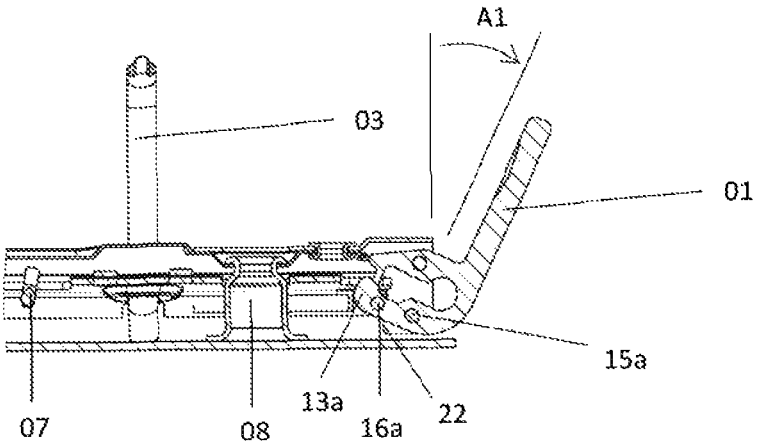
FIG. 9 is an enlarged fragmentary section of the control component and the open longitudinal end of the single-detent binder at open position.
Figure 10:
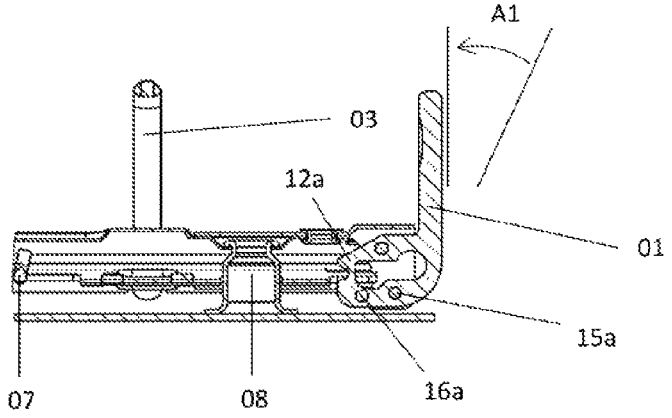
FIG. 10 is an enlarged fragmentary section of the control component and the open longitudinal end of the single-detent binder at closed position.
Figure 11:
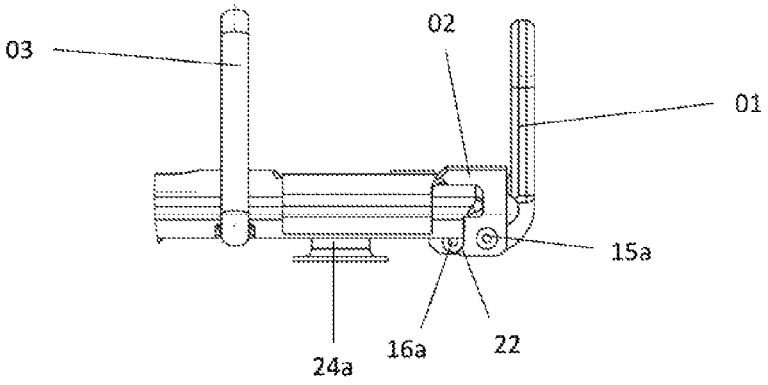
FIG. 11 is an enlarged side view of the control component and the open longitudinal end of the single-detent binder at closed position.
Figure 12:
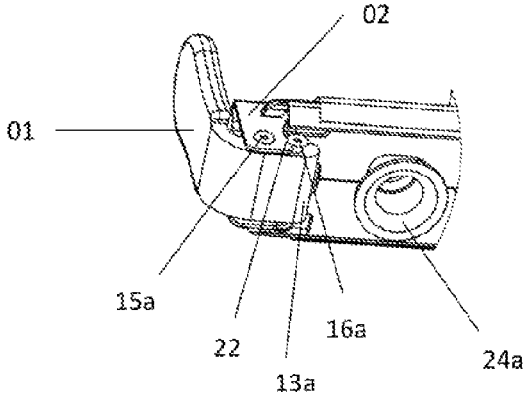
FIG. 12 is an enlarged bottom perspective view of the single-detent binder at the open longitudinal end.
Figure 13:
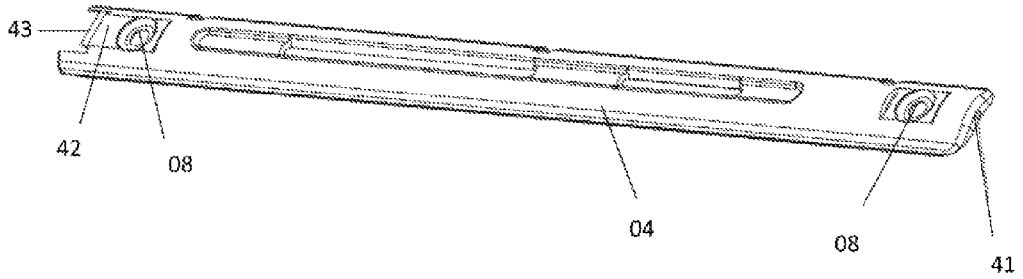
FIG. 13 is a perspective view of the housing.
Figure 14:
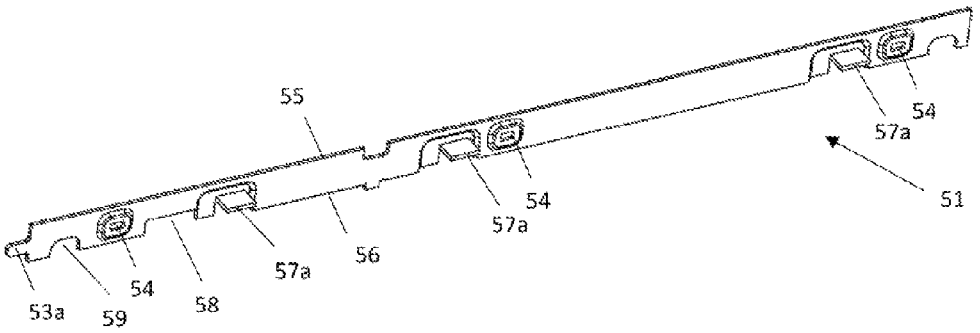
FIG. 14 is a perspective view of the first baseplate.
Figure 15:
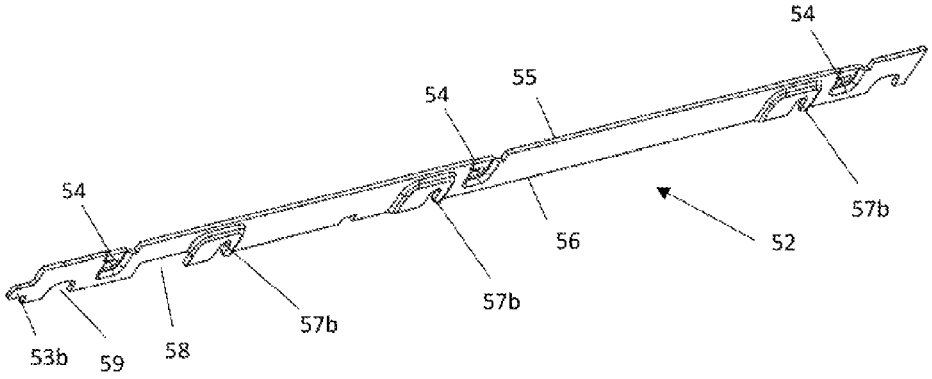
FIG. 15 is a perspective view of the second baseplate.

Between the upper extension arm 12 and the lower extension arm 13 is a central cavity 19, which accommodates the two finger-like parts 53 at one end of the pair of baseplates 05. The notch 53*c* has a width that is slightly more than the width of the bridge 14 on the control component 01, allowing the two finger-like parts 53 to be placed between the upper extension arm 12 and the lower extension arm 13. As illustrated in FIG. 9 and FIG. 12, when the control component 01 rotates downwards and away from the housing 04, the head of the lower extension arm 13*a* adjacent to the bridge applies an upward force to the finger-like parts 53 of the baseplate 05, so that the central hinge of the baseplate 05 pivots upwards to open the ring-shaped components 03. As illustrated in FIG. 10, when the control component 01 rotates upwards and towards the housing 04, the head of the upper extension arm 12*a* adjacent to the bridge applies a downward force to the finger-like parts 53 of the baseplate 05, so that the central hinge of the baseplate 05 pivots downward to occlude the ring-shaped components 03.

In another embodiment, the lower extension arm 13 of the control component 01 is constructed with a guide pin 16*a* and a curved surface 18 so as to improve the durability. As illustrated in FIG. 12, the guide pin 16*a* is not connected to the press cap 02. The press cap is characterized with a curved inner edge 22 on both downward extension parts 27 which is engaged with the guide pin 16*a* for moving along as a guide path. At closed position, the guide pin 16*a* is positioned adjacent to the lower end of the curved inner edge 22. At open position, as shown in FIG. 9, the guide pin 16*a* is moved up towards the housing 04, and is positioned adjacent to the upper end of the curved inner edge 22 closer to the protruding plate 26. As the press cap 02 is firmly locked and fastened to the housing 04 via one or more rivets 25*a*, the curved inner edge 22 provides a track for the guide pin to move along when opening and closing of the single-detent binder. Therefore, the guide pin 16*a* is restricted to move beyond guide path as provided by the curved inner edge 22, and correspondingly the control component 01 is restricted to rotate exceeding the angle of turning A1. In one embodiment, the maximum angle of turning A1 for the control component is between 20 degrees to 30 degrees.

Figure 16:
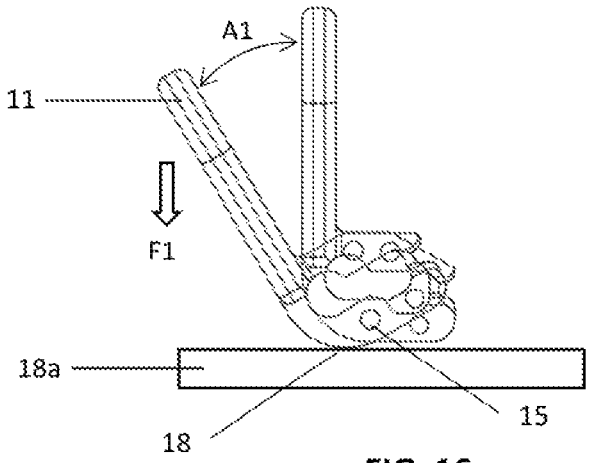
FIG. 16 is an enlarged fragmentary section of the control component demonstrating the rotation of the handle to open or close the binder and the abutment of the control component on the file cover at open position.

The bottom of the handle 11 connecting to the lower extension arm 13 is constructed to have a curved surface 18 that provides a pivot support for the control component 01 at open position. As illustrated in FIG. 16, when the handle 11 of a single-detent binder is rotated by the angle of turning A1 to open position, the curved surface 18 firmly abuts against the file folder or note book 18*a*, which is integrated with such single-detent binder, to serve as a pivot for the control component 01. At the open position, if the user continues to apply an excessive downward force F1 on the handle 11, the downward force F1 applied can be dissipated to the contact between the curved surface 18 and the file folder or note book 18*a*. Therefore, the lower extension arm 13 is not exposed to the excessive downward force F1 and the lower extension arm 13 is less likely to be weakened or deformed.

Figure 19:
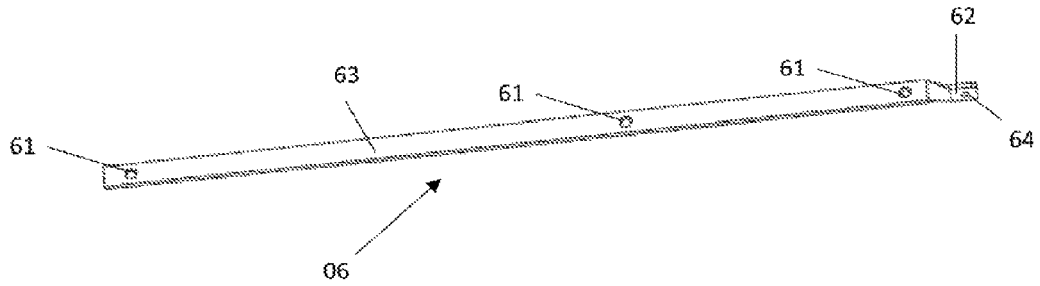
FIG. 19 is an enlarged perspective view of the pull rod.

Referring to FIGS. 3, 4 and 19, the present invention also comprises a pull rod 06, which is made of metal, alloy or other appropriate lightweight material possessing enough rigidity and stability. The pull rod 06 is positioned below the baseplates 05, that is, outside the housing 04. The pull rod 06 comprises a longitudinal extended elongate main rod 63 and a connection end 62. The main rod 63 possesses three round holes 61, which allow the rotary locking nails 71 to pass through them and rotatively connect the rotary locking pieces 07 to the pull rod 06. The connection end 62 possesses a small hole 64, allowing the hooked end 91 of the intermediate junction component 09 to pass through it. The number of round holes 61 is equal to the number of rotary locking pieces 07, which being larger or smaller than the number shown in the figures is within the scope of protection of the present invention.

Figure 17:
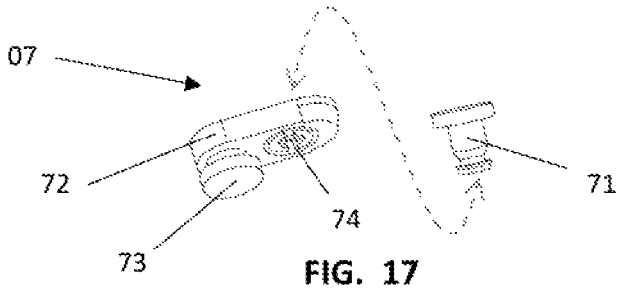
FIG. 17 is an enlarged exploded view of a rotary locking piece and the corresponding rotary locking nail.

As shown in FIGS. 3, 4 and 17, the present invention also comprises a rotary locking piece 07 and rotary locking nail 71, which are made of plastics, metal, alloy or other appropriate lightweight material possessing enough rigidity and stability. The rotary locking piece 07 comprises a main body 72, which assumes an egg shape. At the broad end of the main body 72 comprises a projecting cylinder 73, which is clamped in the trough 57*b* of the second baseplate 52 so as to fix the rotary locking piece 07 on the second baseplate 52 and rotate the rotary locking piece 07 in the trough 57*b*. At the narrow end of the main body 72 is a small hole 74. The rotary locking nail 71 passes through the round hole 61 on the pull rod 06 first and then is inserted into the small hole 74 of the main body 72, thus riveting the rotary locking piece 07 to the pull rod 06 rotatively. The rotary locking piece 07 with other shapes other than an egg shape is within the scope of protection of the present invention. After the rotary locking piece 07 works to close the binder, the ring-shaped components 03 generate a scrambling force, thus enhancing the locking effect and preventing the single-detent binder from opening unexpectedly.

The rotary locking pieces 07 are evenly distributed on the baseplates 05. When the control component 01 applies a force to occlude or disjoin the rings, the force is not only applied upwards to the finger-like part 53 of the baseplate 05 via the head of the lower extension arm 13*a* or the head of the upper extension arm 12*a*, but also transferred to the pull rod 06 and the three rotary locking pieces 07 for exerting evenly distributed forces on the baseplate 05.

Figure 18:
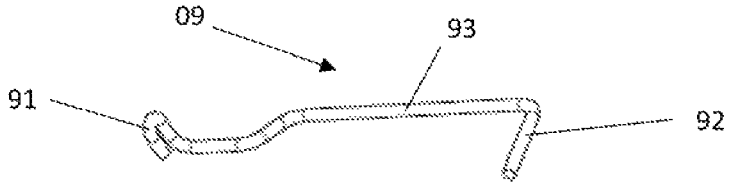
FIG. 18 is an enlarged perspective view of the intermediate junction component.

As shown in FIGS. 3, 4 and 18, the present invention also comprises an intermediate junction component 09, which is positioned between the housing 04 (close to the open end 42) and the baseplate 05. The intermediate junction component 09 comprises a hooked end 91, a widthwise end 92 and an intermediate junction rod 93. The widthwise end 92 of the intermediate junction component 09 passes through the through hole 17 of the upper extension arm 12 and is then connected to the control component 01. Meanwhile, the hooked end 91 of the intermediate junction component 09 is connected to the pull rod 06 by passing through the small hole 64 at the connection end 62 of the pull rod 06. The intermediate junction component 09 connects the control component 01 to the pull rod 06 in series, so that the control component 01 can rotate to trigger longitudinal movement of the pull rod 06. Because the intermediate junction component 09 is positioned between the housing 04 and the baseplate 05 and the pull rod 06 is positioned outside the housing 04 and the baseplate 05, the hooked end 91 passes through the large groove 58 of the baseplate 05 and is exposed outside the bottom surface of the baseplate 05, so as to connect to the connection end 62 of the pull rod 06. The intermediate junction component 09 assuming different shapes or be integrated into a whole with the pull rod 06 is within the scope of the protection of the present invention. If the intermediate junction component 09 is integrated into a whole with the pull rod 06 (the single-detent binder does not comprise the intermediate junction component 09), one end of the pull rod 06 is directly connected to the through hole 17 of the control component 01.

Some of the structure illustrated herein the description and any accompanying figures may be modified or deleted where appropriate, and additional structure may be added without departing from the scope of the disclosure.

Figure 20:
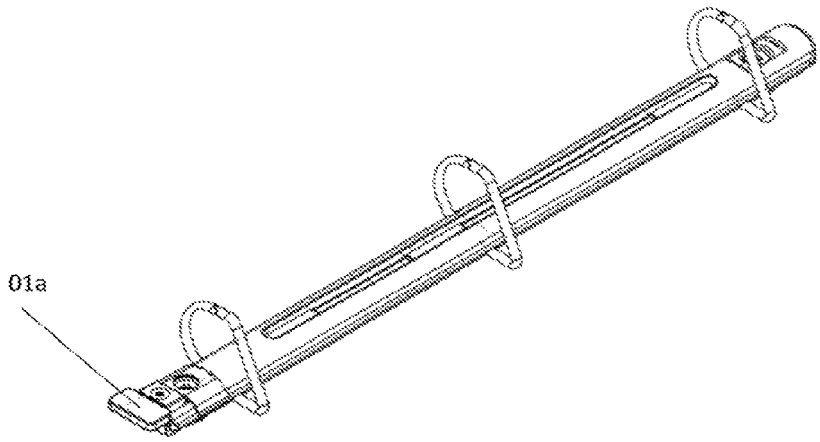
FIG. 20 is a perspective view of an alternative embodiment of a single-detent binder of the present invention.
Figure 21:
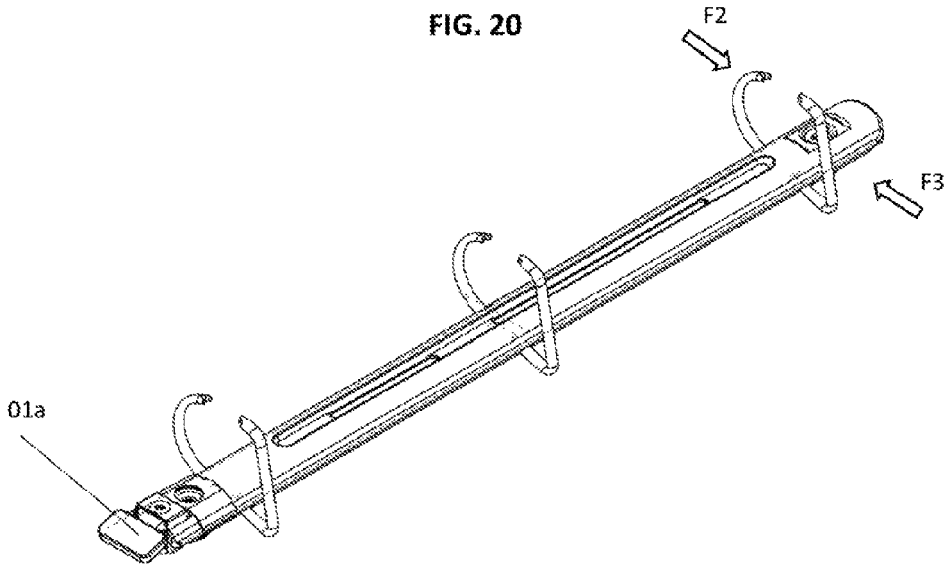
FIG. 21 is a perspective view of the alternative embodiment of the single-detent binder at open position.
Figure 22:
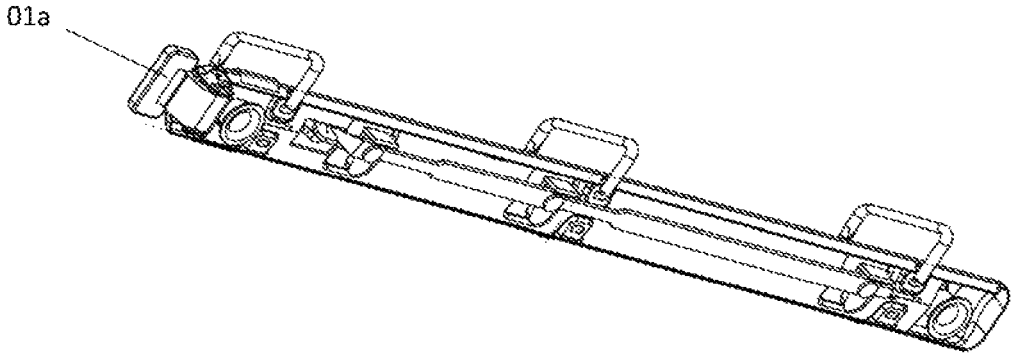
FIG. 22 is a bottom perspective view of the alternative embodiment of the single-detent binder at open position.
Figure 23:
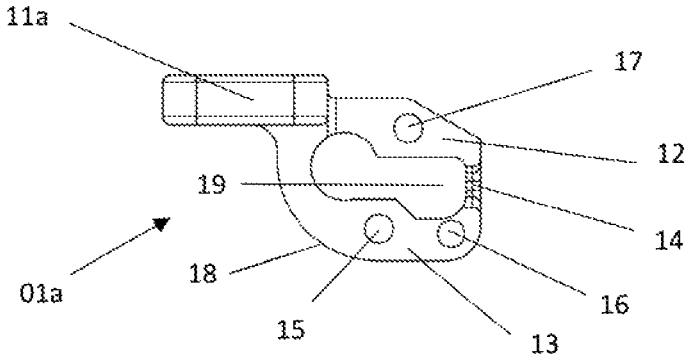
FIG. 23 is a fragmentary section of the control component of the alternative embodiment of the single-detent binder.
Figure 24:
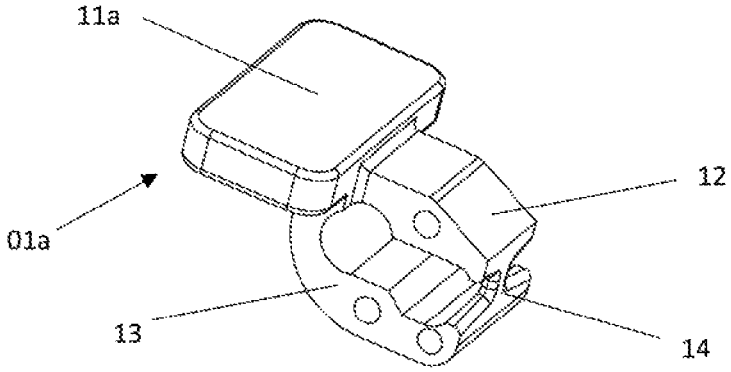
FIG. 24 is a perspective view of the control component of the alternative embodiment of the single-detent binder.
Figure 25:
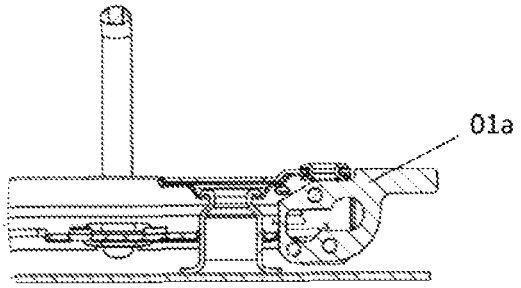
FIG. 25 is an enlarged fragmentary section of the control component and the open longitudinal end of the alternative embodiment of the single-detent binder at closed position.

FIGS. 20 to 25 show an alternative embodiment of the present invention of a single-detent binder with a horizontal control component 01*a*, comprising horizontal handle 11*a*, upper extension arm 12, lower extension arm 13 and a curved surface 18. At closed position as shown in FIG. 20, the user can apply a force to the horizontal handle 11*a* to disjoin the ring-shaped components 03 to form an opened ring. The horizontal handle is rotated downwards after such force is applied, and the control component 01 can pivot around a pivot axis that coincides with the pivot pin 15*a*. At open position as shown in FIG. 21, the user can directly grip one or more ring shaped components 03 and apply two forces of opposite direction (F2 and F3), each on the half parallelogram element 31 and the half circular element 32 of the ring-shaped components 03 to occlude the ring-shaped components 03 and form a closed ring. The horizontal handle 11*a* is rotated upwards to the closed position when the ring-shaped components 03 are closed.

I claim:

1. A single-detent binder for holding loose-leaf paper sheets, comprising:

a housing;

at least one pair of symmetrically elongated baseplates, wherein said baseplates of said one pair of baseplates is longitudinal adjacent and parallelly arranged and connected to each other, wherein said one pair of baseplates comprises adjacent inner longitudinal edges and non-adjacent outer longitudinal edges;

one or more ring shaped components for holding loose-leaf paper, wherein said ring shaped components each comprise two half elements, wherein said half elements each are fixed on said one pair of baseplates and pass through said housing, wherein said half elements occlude to form a closed ring, and said half elements disjoin to form an opened ring;

wherein said one pair of baseplates is so assembled as to pivot around said adjacent inner longitudinal edges in order to open or close said ring shaped components, wherein said one pair of baseplates is supported by said housing;

a pull rod, wherein said pull rod comprises an elongate main rod and a connection end;

a control component operatively connected to said pair of baseplates for pivoting said pair of baseplates around said adjacent inner longitudinal edges for opening and closing the single-detent binder, wherein said control component comprises a handle, an upper extension arm and a lower extension arm, wherein said handle enables said control component to rotate relative to said housing, wherein said upper extension arm is operatively connected to said connection end of said pull rod, wherein said lower extension arm is provided with a pivot pin, so that said control component pivots around a pivot axis that coincides with the pivot pin;

wherein said lower extension arm comprises a guide pin and a curved surface for improving the durability of said upper extension arm and said lower extension arm by providing a pivot for said control component and limiting the rotation of said control component to be within a pre-determined degree when opening and closing the single-detent binder; and wherein said control component comprises at least a bridge or other connectors connecting and bridging a head of said upper extension arm and a head of said lower extension arm of said control component so that said upper extension arm and said lower extension arm form a closed loop with a cavity in the middle.

2. The single-detent binder according to claim 1, wherein said handle of said control component can be rotated by a user relative to said housing for opening and closing of the single-detent binder.

3. The single-detent binder according to claim 1, further comprising an intermediate junction component operatively connected between said pull rod and said control component, wherein said upper extension arm of said control component possesses a through hole for connecting said control component to one end of said intermediate junction component.

4. The single-detent binder according to claim 1, wherein said lower extension arm of said control component applies force on said pair of baseplates and limits the rotation of said control component to be within said pre-determined degree.

5. The single-detent binder according to claim 1, wherein said adjacent inner longitudinal edges of said one pair of baseplates are interconnected in parallel and are pivoted around each other to form a central hinge for opening or closing said ring-shaped components.

6. The single-detent binder according to claim 1, wherein said non-adjacent outer longitudinal edges of said one pair of baseplates abut upon the inner side of said housing.

7. The single-detent binder according to claim 1, further comprising an intermediate junction component, wherein one end of said intermediate junction component has one end connected to said upper extension arm, and the other end of said intermediate junction component is connected to said pull rod.

8. The single-detent binder according to claim 1, further comprising an intermediate junction component, wherein said intermediate junction component comprises a hooked end, a widthwise end and an intermediate junction rod, wherein the widthwise end of said intermediate junction component is connected to the control component via an open trough on the upper extension arm, and the hooked end of said intermediate junction component is connected to the pull rod via a small hole at the connection end of the pull rod.

9. The single-detent binder according to claim 1, further comprising at least one rotary locking nail and at least one rotary locking piece, wherein said rotary locking nail rotativity connects one end of said rotary locking piece to a round hole on said pull rod, and the other end of said rotary locking piece is clamped to one of said baseplates.

10. The single-detent binder according to claim 1, wherein said bridge of said control component connects said upper extension arm and lower extension arm of said control component to form a closed loop for preventing said upper extension arm and said lower extension arm from bending or cracking after prolonged use of the binder.

11. The single-detent binder according to claim 1, wherein said baseplates comprise two finger-like parts at the open longitudinal end of said pair of baseplates, wherein said two finger-like parts are arranged laterally, separated by a notch of a width more than the width of said bridge and are connected to said cavity of said control component.

12. The single-detent binder according to claim 1, wherein said control component abuts on the file folder or note book at an open position of the single-detent binder to provide a pivot for said control component, wherein said single-detent binder further comprises a press cap, wherein said press cap comprises at least one downward extension part, wherein said press cap connects and fixes said control component to said housing, wherein said downward extension part of said press cap comprises a curved inner edge, wherein said curved inner edge of said downward extension part obstructs the movement of said guide pin on said lower extension arm which in turn prevents said control component from rotating exceeding a pre-determined angle of turning when opening and closing the single-detent binder.

13. The single-detent binder according to claim 12, wherein said guide pin is position adjacent to said curved inner edge and movable along said curved inner edge so as to limit the rotation of said control component to be within said pre-determined degree.

14. A single-detent binder for holding loose-leaf paper sheets, comprising:

a housing;

at least one pair of symmetrically elongated baseplates, wherein said baseplates of said one pair of baseplates is longitudinal adjacent and parallelly arranged and connected to each other, wherein said one pair of baseplates comprises adjacent inner longitudinal edges and non-adjacent outer longitudinal edges;

one or more ring shaped components for holding loose-leaf paper, wherein said ring shaped components each comprise two half elements, wherein said half elements each are fixed on said one pair of baseplates and pass through said housing, wherein said half elements occlude to form a closed ring, and said half elements disjoin to form an opened ring;

wherein said one pair of baseplates is so assembled as to pivot around said adjacent inner longitudinal edges in order to open or close said ring shaped components, and wherein said one pair of baseplates is supported by said housing;

a pull rod, wherein said pull rod comprises an elongate main rod and a connection end;

a control component operatively connected to said pair of baseplates for pivoting said pair of baseplates around said adjacent inner longitudinal edges for opening and closing the single-detent binder, wherein said control component comprises a handle, an upper extension arm and a lower extension arm, wherein said handle enables said control component to rotate relative to said housing, wherein said upper extension arm is operatively connected to said connection end of said pull rod, wherein said lower extension arm is provided with a pivot pin, so that said control component pivots around a pivot axis that coincides with the pivot pin;

wherein said lower extension arm comprises a guide pin and a curved surface for improving the durability of said upper extension arm and said lower extension arm by providing a pivot for said control component and limiting the rotation of said control component to be within a pre-determined degree when opening and closing the single-detent binder; and a press cap, wherein said press cap comprises two downward extension parts, wherein said press cap connects and fixes said control component to said housing.

15. The single-detent binder according to claim 14, wherein said press cap connects and fixes said control component to said housing via one or more rivets.

16. The single-detent binder according to claim 14, wherein at least one of said downward extension parts of said press cap comprises a curved inner edge as a guide path for said guide pin to be placed adjacent to and move along with so as to limit the rotation of said control component to be within said pre-determined degree.

17. The single-detent binder according to claim 16, wherein said curved inner edge of said downward extension part obstructs the movement of said guide pin on said lower extension arm which in turn prevents said control component from rotating exceeding a pre-determined angle of turning when opening and closing the single-detent binder.

18. The single-detent binder according to claim 14, wherein said handle of said control component is extended downwards and connected to said lower extension arm with said curved surface.

19. The single-detent binder according to claim 14, wherein said curved surface, connecting between said handle and said lower extension arm, firmly abuts against the file folder or note book at open position of the single-detent binder and serves as a pivot for said control component.

20. The single-detent binder according to claim 14, further comprising an intermediate junction component, wherein said intermediate junction component comprises a hooked end, a widthwise end and an intermediate junction rod, wherein the widthwise end of said intermediate junction component is connected to the control component via an open trough on the upper extension arm, and the hooked end of said intermediate junction component is connected to the pull rod via a small hole at the connection end of the pull rod.

21. The single-detent binder according to claim 14, wherein said control component comprises at least a bridge or other connectors connecting and bridging a head of said upper extension arm and a head of said lower extension arm of said control component so that said upper extension arm and said lower extension arm form a closed loop with a cavity in the middle.

* * * * *